US011633000B2

(12) United States Patent
Dumph

(10) Patent No.: US 11,633,000 B2
(45) Date of Patent: Apr. 25, 2023

(54) TACTICAL HELMET RETENTION HARNESS WITH SNAPBACK ADJUSTMENT ASSEMBLY

(71) Applicant: Hard Head Veterans LLC, Rollinsville, CO (US)

(72) Inventor: Christopher Dumph, Blackhawk, CO (US)

(73) Assignee: Hard Head Veterans LLC, Rollinsville, CO (US)

( * ) Notice: Subject to any disclaimer, the term of this patent is extended or adjusted under 35 U.S.C. 154(b) by 192 days.

(21) Appl. No.: 17/371,681

(22) Filed: Jul. 9, 2021

(65) Prior Publication Data

US 2023/0012326 A1 Jan. 12, 2023

(51) Int. Cl.
*A42B 3/08* (2006.01)
*A42B 3/14* (2006.01)

(52) U.S. Cl.
CPC . *A42B 3/08* (2013.01); *A42B 3/14* (2013.01)

(58) Field of Classification Search
CPC ..... A42B 3/08; A42B 3/14; A42B 3/145
See application file for complete search history.

(56) References Cited

U.S. PATENT DOCUMENTS 4,354,283 A * 10/1982 Gooding ..... A42B 3/14 2/413
4,578,824 A * 4/1986 Waldron ..... A41F 9/025 2/919
4,862,563 A * 9/1989 Flynn ..... F16B 2/08 24/442
4,884,301 A * 12/1989 Aileo ..... A42B 3/10 2/909
5,289,619 A * 3/1994 Pileggi ..... B42D 3/10 24/17 AP
5,608,917 A * 3/1997 Landis ..... A42B 3/14 2/418
5,970,526 A * 10/1999 Weathers ..... A41F 9/002 2/920
7,178,175 B2 2/2007 Rogers et al.
9,307,802 B2 * 4/2016 Hall ..... A42B 3/145
9,743,701 B2 8/2017 Javorek et al.
11,391,546 B2 * 7/2022 Banducci ..... A42B 3/085
2012/0278977 A1 11/2012 Rocklin
2017/0273390 A1 9/2017 Maloney
2020/0253315 A1 8/2020 Maloney

FOREIGN PATENT DOCUMENTS

GB 2382375 A * 5/2003 ..... A01K 27/005

* cited by examiner

*Primary Examiner* — Tajash D Patel
(74) *Attorney, Agent, or Firm* — Jenei LLC

(57) ABSTRACT

A tactical helmet assembly has a helmet retention harness includes left and right straps that form a snapback adjustment assembly. The first strap has a first end with a helmet mounting feature mountable to a first lateral, interior side of a helmet. The first strap includes a second end having a first strap slot. The first strap presents snap stud(s) on a first surface. The snapback adjustment assembly includes a second strap having a first end inserted through the first strap slot of the first strap. the second strap includes a helmet mounting feature mountable to a second lateral, interior side of the helmet. The second strap includes a second end having a second strap slot through which the first end of the first strap is inserted. The second strap presents more than one eyelets longitudinally aligned to receive the snap stud(s) of the first strap.

4 Claims, 7 Drawing Sheets

FIG. 5

TACTICAL HELMET RETENTION HARNESS WITH SNAPBACK ADJUSTMENT ASSEMBLY

FIELD OF THE INVENTION

The present disclosure generally relates to tactical helmet retention harnesses, and more particular to tactical helmet retention harnesses having a manual adjustment feature.

BACKGROUND OF THE INVENTION

Tactical helmets generally include a helmet shell, liner, and a helmet retention harness. The helmet shell provides ballistic or impact protection to the head. For comfort and to spread impact forces, a shock absorbing liner is attached to an inner surface of the helmet shell. An upper portion of a head of wearer contacts the liner. To retain the helmet shell and liner on the head of the wearer, the helmet retention harness is attached to the helmet shell and engages the chin and nape of the neck of the wearer. Proper adjustment of the helmet retention harness is required for comfort and effective retention of the tactical helmet. Adjustments are usually accomplished at 4 points, and occasionally a dial type system as a 5th point that tightens around the circumference of the head. The dial type systems for the 5th point are complex and bulky that adds weight and failure points to the suspension system for circumference adjustment.

SUMMARY OF THE INVENTION

According to one aspects, a helmet retention harness includes a snapback adjustment assembly. The snapback adjustment assembly includes a first strap having a first end with a helmet mounting feature mountable to a first lateral, interior side of a helmet. The first strap includes a second end having a first strap slot. The first strap presents one or more snap studs on a first surface. The snapback adjustment assembly includes a second strap having a first end inserted through the first strap slot of the first strap. the second strap includes a helmet mounting feature mountable to a second lateral, interior side of the helmet. The second strap includes a second end having a second strap slot through which the first end of the first strap is inserted. The second strap presents more than one eyelets longitudinally aligned with a length of the second strap to receive the one or more snap studs of the first strap.

According to another aspect, a tactical helmet assembly includes a helmet and a helmet retention harness. The helmet retention harness includes a snapback adjustment assembly. The snapback adjustment assembly includes a first strap having a first end with a helmet mounting feature mountable to a first lateral, interior side of a helmet. The first strap includes a second end having a first strap slot. The first strap presents one or more snap studs on a first surface. The snapback adjustment assembly includes a second strap having a first end inserted through the first strap slot of the first strap. the second strap includes a helmet mounting feature mountable to a second lateral, interior side of the helmet. The second strap includes a second end having a second strap slot through which the first end of the first strap is inserted. The second strap presents more than one eyelets longitudinally aligned with a length of the second strap to receive the one or more snap studs of the first strap.

Helmets are used in a wide variety of applications and offer a broad range of protection. Exemplary applications for helmets include sports, cycling, industrial, and ballistic protection helmets. To provide the desired level of protection, it is often desirable to have a firm fit to the wearer's head. The fit can be provided, in part, by pads or webbing inside the helmet. However, most helmets include a retention system including straps (e.g., chin straps) and bands (e.g., a head band) to insure a secure and firm fit.

Typically, the desired fit will hold the helmet securely in place during use and minimize or eliminate undesired movement of the helmet relative the wearer's head. However, the tightness of such a fit can make putting on and taking off the helmet difficult. In addition, the pressure needed for a secure fit can create discomfort if applied for extended periods of time. These concerns have been addressed by including an adjustment mechanism that can be used to increase or decrease the securement features while the helmet is in place. For example, the features may be loosened prior to putting on the helmet, and only tightened after the helmet is in place. Similarly, the features can be loosened again before removing the helmet. Such adjustment mechanisms may also allow one size of helmet to be used over a range of head sizes, as the fit can be adjusted to accommodate variations in head sizes and shapes.

In some applications, adjustment mechanisms may be used to reduce the pressure at times when less protection is needed, e.g., between plays for sports helmets, while resting for cycling helmets, or when in a secure location for ballistic helmets. The mechanism can then be used to increase the pressure only when protection is required. In such situations, simple, one-handed adjustment of the mechanism can be beneficial.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

A tactical helmet assembly has a helmet retention harness includes left and right straps that form a snapback adjustment assembly. The first strap has a first end with a helmet mounting feature mountable to a first lateral, interior side of a helmet. The first strap includes a second end having a first strap slot. The first strap presents snap stud(s) on a first surface. The snapback adjustment assembly includes a second strap having a first end inserted through the first strap slot of the first strap. the second strap includes a helmet mounting feature mountable to a second lateral, interior side of the helmet. The second strap includes a second end having a second strap slot through which the first end of the first strap is inserted. The second strap presents more than one eyelets longitudinally aligned to receive the snap stud(s) of the first strap.

Figure 1:
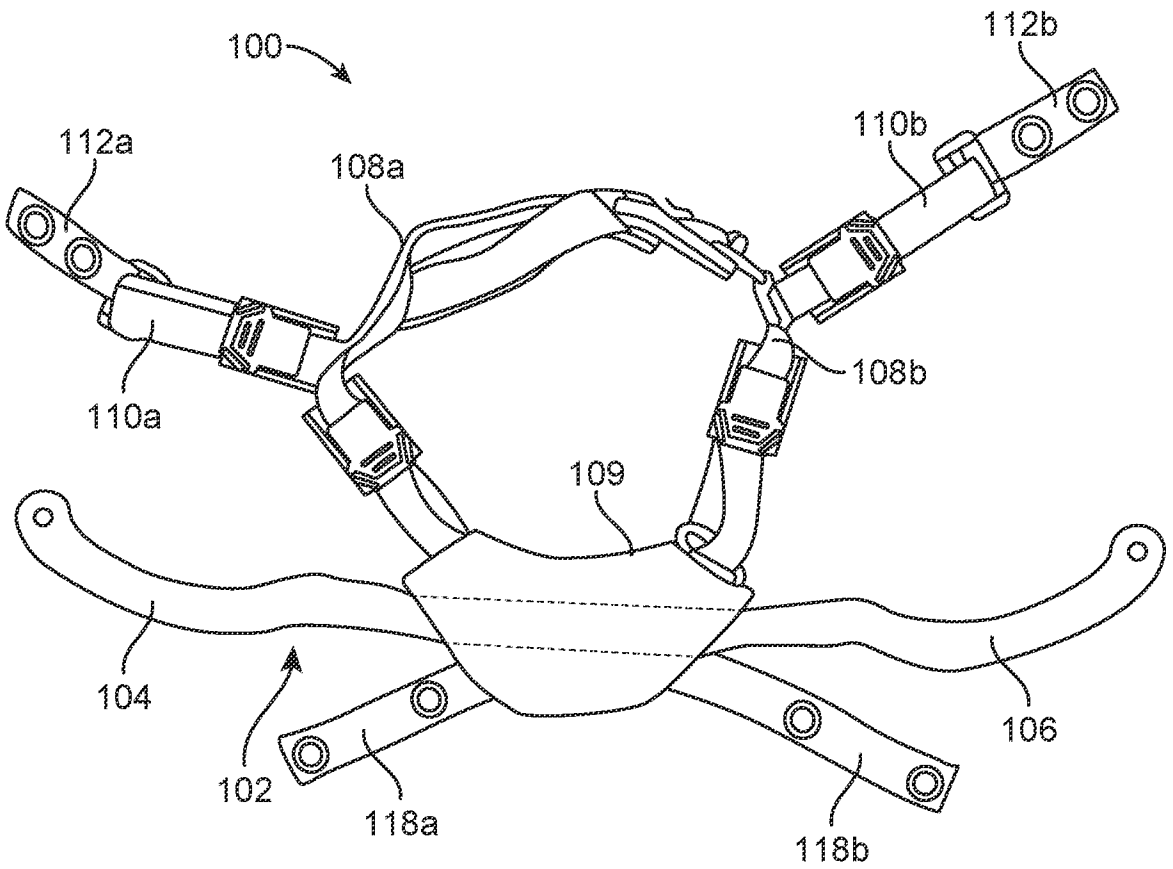
FIG. 1 is a three-dimensional view of the example helmet retention harness in a loosened state, according to one or more embodiments.
Figure 2:
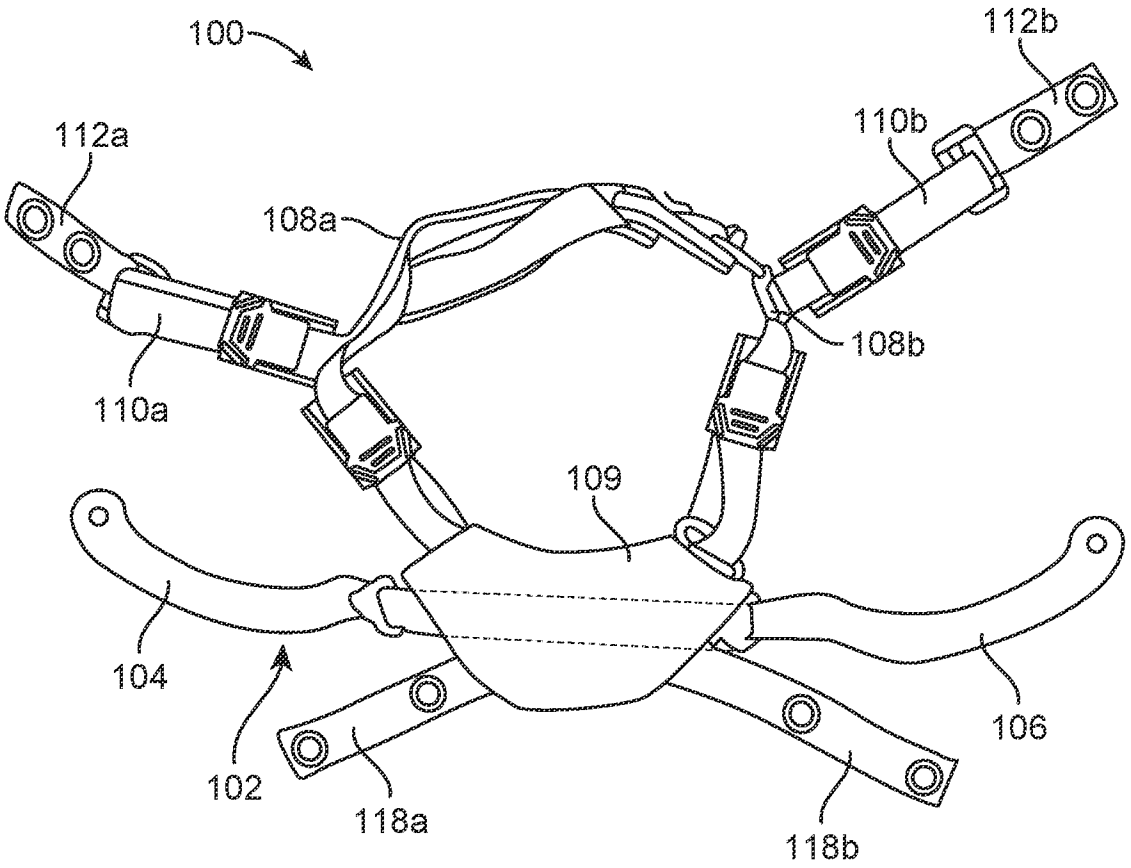
FIG. 2 is a three-dimensional view of the example helmet retention harness of FIG. 1 in a tightened state, according to one or more embodiments.

Turning to the Drawings, in which the same reference numeral refers to the same component in the several views, FIG. 1 is a three-dimensional view of the example helmet retention harness 100 with a snapback adjustment assembly 102 in a loosened state. FIG. 2 is a three-dimensional view of the example helmet retention harness 100 with the snapback adjustment assembly 102 in a tightened state. The snapback adjustment assembly 102 includes first and second straps, which can be positioned as left and right straps 104, 106. An amount of engaged overlap of the right and left straps 104, 106 determines an overall length of the snapback adjustment assembly 102. The length adjustment is accomplished with the left and right straps 104, 106 disengaged from each other during relative longitudinal movement to a selected length and then engaged to maintain the selected length. The engagement does not slip like a buckle undergoing tension.

In addition, the helmet retention harness 100 includes left and right harness portions 108*a*-108*b* extending from a rear harness portion 109. The helmet retention harness 100 includes left and right temple straps 110*a*-110*b* having respective top ends 112*a*-112*b* extending down to engage to the left and right harness portions 108*a*-108*b*. The snapback adjustment assembly 102 is received for longitudinal adjustment through a backside of the rear pad 114 of the rear harness portion 109 and through a vertical retention loop 116. The rear harness portion 109 is attachable using left and right tabs 118*a*-118*b*.

Figure 3:
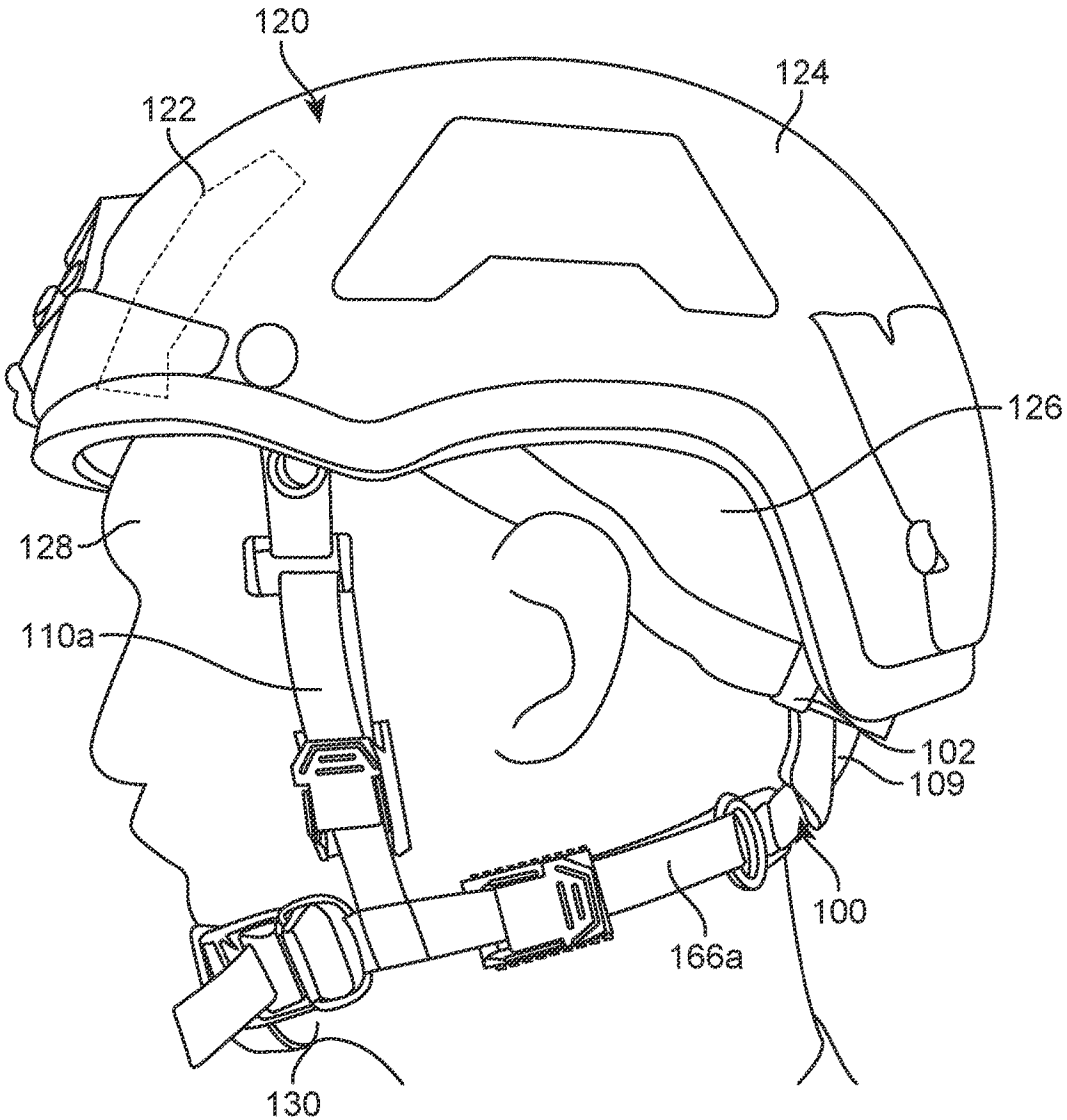
FIG. 3 is a left side view of a tactical helmet with the example helmet retention harness of FIG. 1, according to one or more embodiments.
Figure 4:
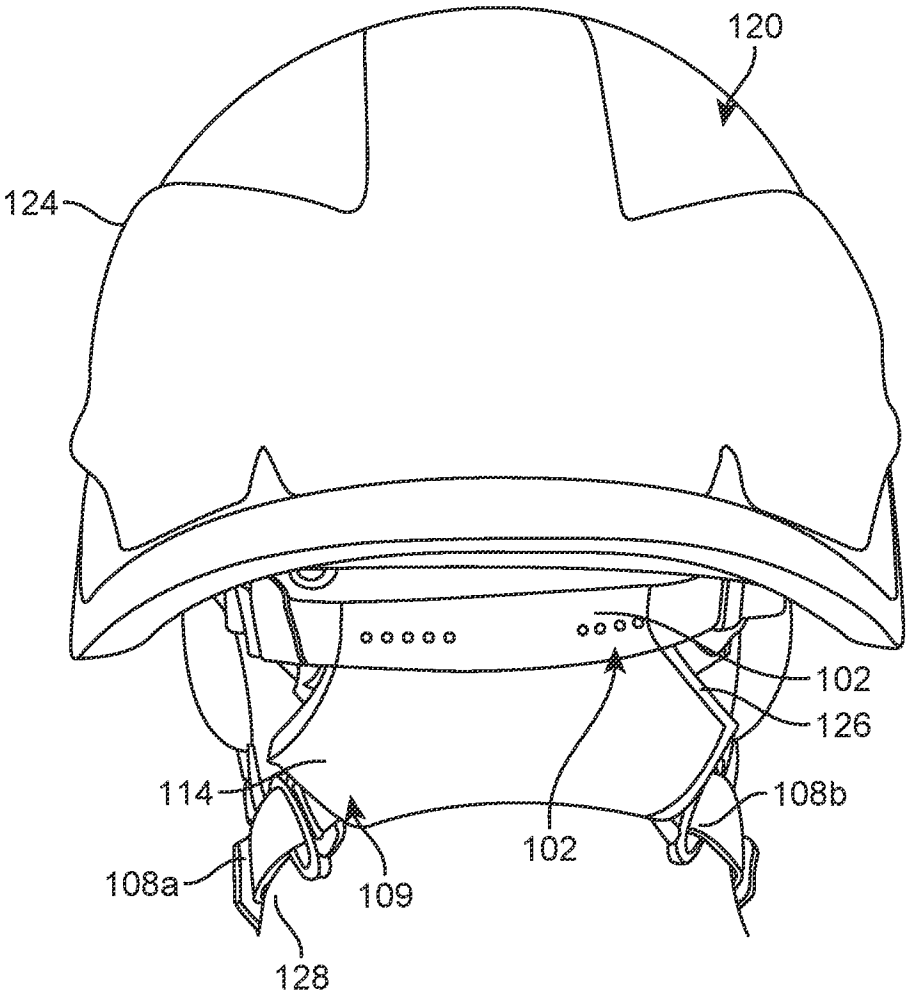
FIG. 4 is a back side view of the tactical helmet of FIG. 3, according to one or more embodiments.

FIG. 3 depicts a left side view of a tactical helmet 120 with the example helmet retention harness 100. FIG. 4 is a back side view of the tactical helmet 122 with the example helmet retention harness 100. The tactical helmet 120 has a helmet liner 122 (FIG. 3) received in a helmet shell 124. The helmet retention harness 100 includes a rear harness portion 109. The rear harness portion 109 includes a rear pad 114 with rearward vertical retention loop 116 attached at top and bottom to the rear pad 114. The rear harness portion 109 is attachable to a rear portion of the helmet shell 124 via left and right tabs 118*a*-118*b* (FIG. 1) extending downward to contact a back lower portion of a head 126 of a wearer 128. The helmet retention harness 100 includes left and right harness portions 108*a*-108*b* extending from the rear harness portion 109 and attachable at forward ends to engage a chin 130 (FIG. 1) of the wearer 128.

Figure 5:
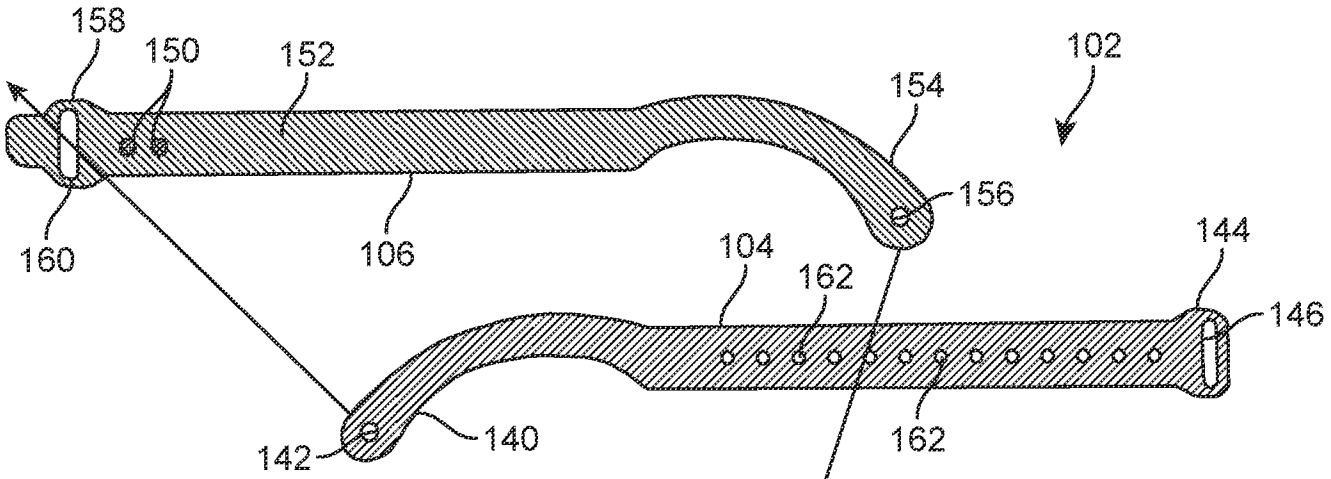
FIG. 5 illustrates a side disassembled view of left and right straps of a snapback adjustment assembly of the helmet retention harness, according to one or more embodiments.
Figure 6:
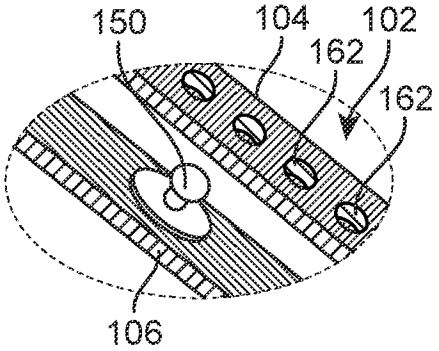
FIG. 6 illustrates a three-dimensional detail view of a snapback adjustment assembly provided by the left and right straps and that are in a disengaged state, according to one or more embodiments.
Figure 7:
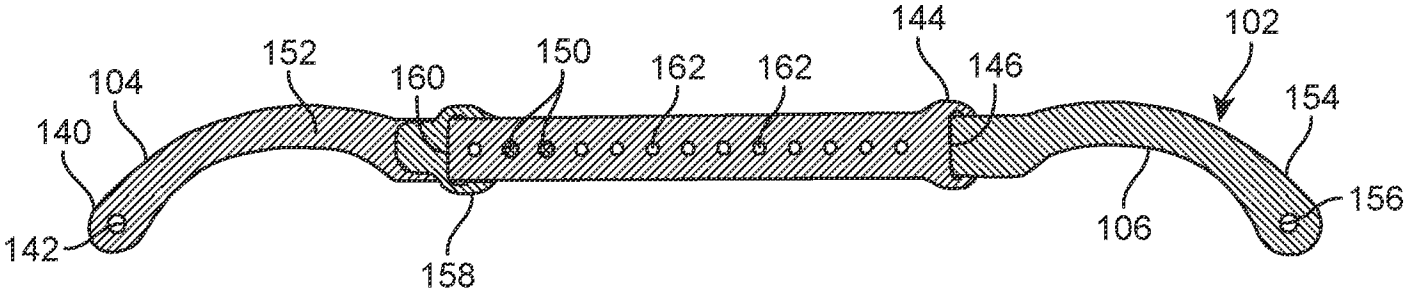
FIG. 7 illustrates a side view of the left and right straps assembled and engaged to provide the snapback adjustment assembly at a first (shorter) length, according to one or more embodiments.
Figure 8:
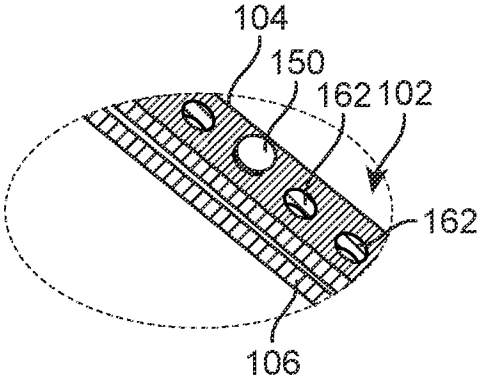
FIG. 8 illustrates a three-dimensional detail view of the snapback adjustment assembly provided by the left and right straps and that are in an engaged state, according to one or more embodiments.
Figure 9:
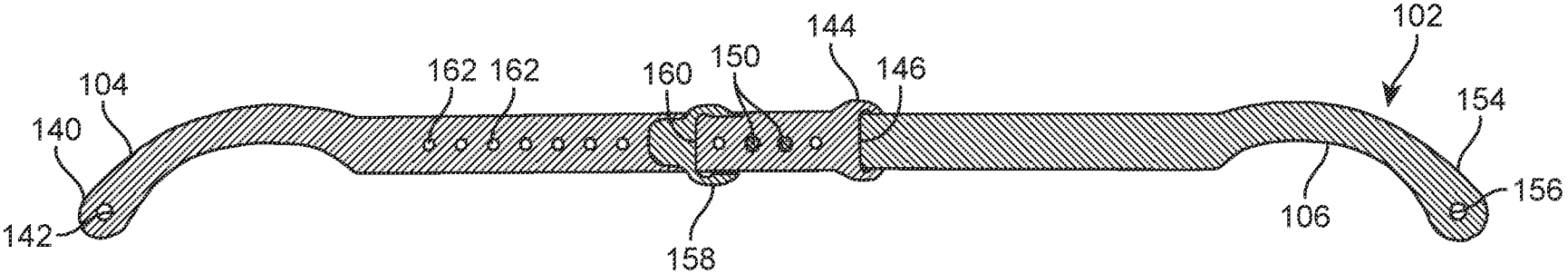
FIG. 9 illustrates a side view of the left and right straps assembled and engaged to provide the snapback adjustment assembly at a second (longer) length, according to one or more embodiments.

FIG. 5 illustrates a side disassembled view of the left and right straps 104, 106 of the snapback adjustment assembly 102 of the helmet retention harness 100. FIG. 6 illustrates a three-dimensional detail view of the snapback adjustment assembly 102 provided by the left and right straps 104, 106 that are in a disengaged state. FIG. 7 illustrates a side view of the left and right straps 104, 106 assembled and engaged to provide the snapback adjustment assembly 102 at a first (shorter) length. FIG. 8 illustrates a three-dimensional detail view of the snapback adjustment assembly 102 provided by the left and right straps 104, 106 that are in an engaged state. FIG. 9 illustrates a side view of the left and right straps 104, 106 assembled and engaged to provide the snapback adjustment assembly 102 at a second (longer) length. With particular reference to FIG. 5, the left strap 104 has a first end 140 with a helmet mounting feature (hole 142) mountable to a first lateral, interior side of a helmet 120 (FIG. 1). The left strap 104 has second end 144 having a first strap slot 146. The right strap 106 has a first end 154 inserted through the first strap slot 146 of the left strap 104. The first end 154 of the right strap 106 has a helmet mounting feature (hole 156) mountable to a second lateral, interior side of the helmet 120. A second end 158 of the right strap 106 has a second strap slot 160 through which the first end 140 of the left strap 104 is inserted. The right strap 104 presenting one or more snap studs 150 on a first outward surface 152. The left strap 104 presents eyelets 162 longitudinally aligned with a length of the left strap 104 to receive the one or more snap studs 150 of the right strap 106.

Figure 10:
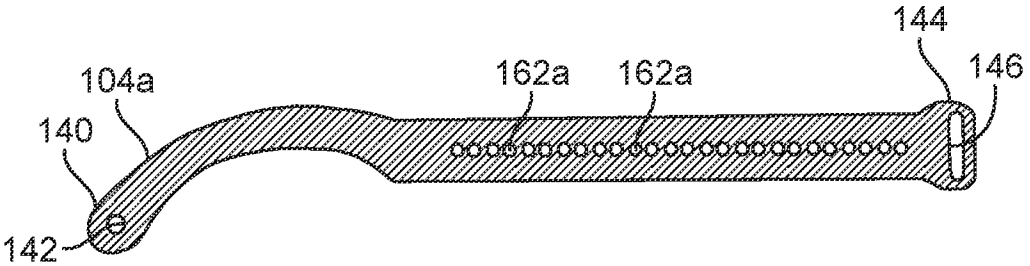
FIG. 10 illustrates a side view of an alternate left strap having additional eyelets providing a snapback adjustment assembly with more granular length adjustment, according to one or more embodiments.
Figure 11:
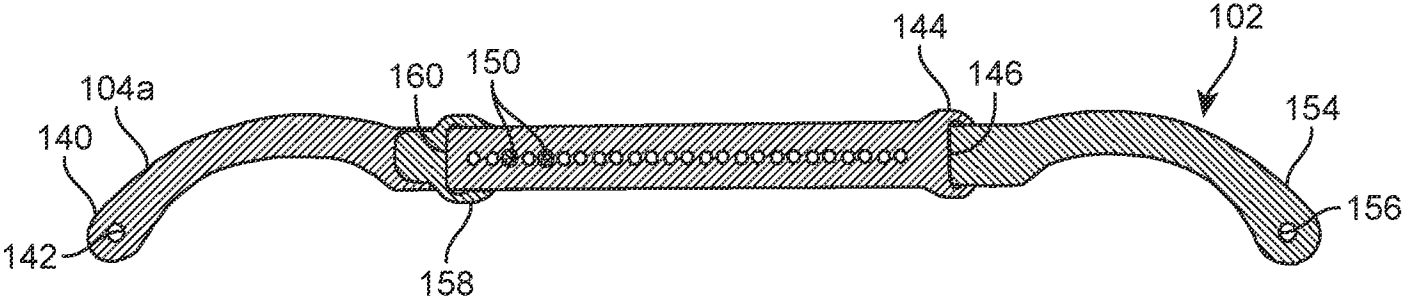
FIG. 11 illustrates a side view of the alternate left strap and the right straps assembled and engaged to provide the snapback adjustment assembly of FIG. 10 at the more granularly adjusted length, according to one or more embodiments.

FIG. 10 illustrates a side view of an alternate left strap 104*a* having additional eyelets 162*a* spaced within the same longitudinal distance providing a snapback adjustment assembly 102*a* with more granular length adjustment. FIG. 11 illustrates a side view of the alternate left strap and the right strap 104*a*, 106 assembled and engaged to provide the snapback adjustment assembly 102*a* at the more granularly adjusted length.

Generally, any known materials may be used to construct the helmet retentions systems of the disclosure. Such materials and parts are readily available to one of ordinary skill in the art. In one or more embodiments, the helmet retention harness 100 may be constructed of straps made of suitable webbing. Webbing may include various straps (e.g., chin strap), buckles, clips, and fasteners, e.g., repositionable fasteners. For example, many helmet retention systems include various clips and fasteners to secure the helmet retention system to the helmet, and various buckles and straps to secure the helmet to the wearer's head. However, the presence, number and location of such elements can be selected for the intended purpose and to complement the overall helmet design.

The helmet shell 124 may be formed of polymeric materials including thermoplastic, thermoset or both, made into a composite structure. In some embodiments, helmet shell 124 is made from the same polymeric material, it is not necessary, and they may be chosen as different materials, taking into account the weight of the materials, the cost, the required ballistic performance, and the like.

While composites are typically understood to include two or more materials, as understood herein with regard to helmet shell 124, composites include multiple layers of one or more materials stacked and consolidated together through the use of heat, pressure, adhesives, matrix materials or combinations thereof. In embodiments, the composites include woven or non-woven fabrics or films. When employed herein, the fabrics are formed of fibers or yarns including materials, such as, but not limited to, ultra-high molecular weight polyethylene (UHMWPE) such as DYNEEMA available from DSM or SPECTRA available from Honeywell; para-aramid material such as KEVLAR available from DuPont or TWARON available from Teijin-Aramid; polyamide; polyester; or combinations thereof. From 1 to 100 layers of fabric or film may be included within a stack (for a helmet shell, from 8 to 100 is more common), including all values and ranges therein.

In one or more embodiments, a number of helmet pads may be positioned within helmet shell 124. Any number of helmet pads may be provided within the helmet covering from 10% to 100% of the inner surface area of the helmet shell 124, including all values and ranges therein, such as 50% to 95% of the inner surface area, etc. Such helmet pads are traditionally used to provide comfort as well as protection from blunt force impact. As described herein, the presently disclosed helmet pads also provide ballistic protection to the wearer.

In one or more embodiments, the helmet pads may be positioned in discrete locations around the inner surface of the shell. In some examples, a 3-7 pad configuration may be used with three pads positioned in the rear of the helmet, three in the front of the helmet and one at the crown. In other examples, a three pad system may be used, one in the front, one in the rear and one at the crown. In further examples, a single helmet pad may be provided as a layer that covers all or a portion of the inner surface area of the shell.

In one or more embodiments, the helmet pads are understood as compressible pads that deflect upon the application of force, absorbing energy. In one or more embodiments, the helmet pads exhibit a compression force deflection of 5 to 200 kPa upon the application of a 25% strain at a rate of 0.2 inches per minute. Such measurements may be made according to ASTM D-3575-08.

In one or more embodiments, helmet pads may be formed from foam, thermoplastic sheets formed with impact absorbing geometries, or foam and thermoplastic sheet composites wherein the composites may include at least one layer of foam and one or more layers of a thermoplastic sheet, with or without impact absorbing geometries. The foam may be open cell or closed cell foam. Open cell foam may be understood as foam which includes a substantial portion of cells, at least 40% by volume, which have cell walls with openings connecting adjacent cells. Closed cell foams may be understood as foam wherein at least 40% by volume of the cells are isolated from or completely closed to adjacent cells. The foam may be formed from polyurethane or silicone materials.

In addition, when thermoplastic sheet material is used, the thermoplastic sheet material may include polyolefins, polystyrene, acrylic, polycarbonate, polyesters, polyamide including aliphatic, aromatic and semi-aromatic polyamides, copolymers or blends thereof.

In one or more embodiments, one or more helmet pads are positioned in the helmet shell between the wearer's head and the helmet shell and relative to a through-hole and/or ballistic grade fastener so as to at least partially, and in embodiments completely, cover such through-hole and/or ballistic grade fastener. Stated another way, when there is a through-hole and/or ballistic grade fastener that penetrates the helmet shell, a helmet pad is provided between the wearer's head and such through-hole and/or ballistic grade fastener. In this manner, the present invention may increase the safety of the wearer by protecting against fragmentation and/or spall produced by ballistic trauma at the through-hole and/or ballistic grade fastener, which is a weak-point in the helmet shell.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A helmet retention harness comprising:

a snapback adjustment assembly comprising:

a first strap having a first end with a helmet mounting feature mountable to a first lateral, interior side of a helmet and a second end having a first strap slot, the first strap presenting one or more snap studs on a first surface; and a second strap having a first end inserted through the first strap slot of the first strap and with a helmet mounting feature mountable to a second lateral, interior side of the helmet and a second end having a second strap slot through which the first end of the first strap is inserted, the second strap presenting more than one eyelets longitudinally aligned with a length of the second strap to receive the one or more snap studs of the first strap.

2. The helmet retention harness of claim 1, further comprising:

a rear harness portion attachable to a rear portion of a helmet shell extending downward to contact a back lower portion of a wearer's head;

left and right harness portions extending from the rear harness portion and attachable at forward ends to engage a chin of the wearer; and left and right temple straps having respective top ends attachable to respective forward lateral sides of the helmet shell and extending down to engage to the left and right harness portions proximate to the chin of the wearer, wherein the snapback adjustment assembly is received for lateral sliding adjustment through the rear harness portion.

3. A tactical helmet comprising:

a helmet shell;

a helmet retention harness comprising:

a snapback adjustment assembly comprising:

a first strap having a first end with a helmet mounting feature mountable to a first lateral, interior side of a helmet and a second end having a first strap slot, the first strap presenting one or more snap studs on a first surface; and a second strap having a first end inserted through the first strap slot of the first strap and with a helmet mounting feature mountable to a second lateral, interior side of the helmet and a second end having a second strap slot through which the first end of the first strap is inserted, the second strap presenting more than one eyelets longitudinally aligned with a length of the second strap to receive the one or more snap studs of the first strap.

4. The tactical helmet of claim 3, wherein the helmet retention harness further comprises:

a rear harness portion attachable to a rear portion of a helmet shell extending downward to contact a back lower portion of a wearer's head;

left and right harness portions extending from the rear harness portion and attachable at forward ends to engage a chin of the wearer; and left and right temple straps having respective top ends attachable to respective forward lateral sides of the helmet shell and extending down to engage to the left and right harness portions proximate to the chin of the wearer, wherein the snapback adjustment assembly is received for lateral sliding adjustment through the rear harness portion.

* * * * *